United States Patent [19]

Criblez

[11] 4,186,589

[45] Feb. 5, 1980

[54] APPARATUS FOR FEEDING WORKPIECES IN A MULTI-STATION CROSS-FED PRESS

[75] Inventor: Roger Criblez, Bottmingen, Switzerland

[73] Assignee: Hatebur Umformmaschinen AG, Basel, Switzerland

[21] Appl. No.: 894,160

[22] Filed: Apr. 6, 1978

[30] Foreign Application Priority Data

Apr. 9, 1977 [DE] Fed. Rep. of Germany ..... 2715966

[51] Int. Cl.[2] ..... B21D 43/05

[52] U.S. Cl. ..... 72/405; 72/421

[58] Field of Search ..... 72/405, 404, 421; 214/1 BB; 10/11 T, 12 T

[56] References Cited

U.S. PATENT DOCUMENTS

| | | | |
|---|---|---|---|
| 2,736,909 | 3/1956 | Hatebur | 10/76 |
| 3,421,637 | 1/1969 | Sofv | 214/1 BB |
| 3,655,070 | 4/1972 | Haydu | 214/1 BB |
| 3,757,961 | 9/1973 | Jacobs | 214/1 BB |
| 3,831,411 | 8/1974 | Sakai | 10/11 G |
| 3,965,718 | 8/1976 | Kline | 10/12 T |

FOREIGN PATENT DOCUMENTS

| | | |
|---|---|---|
| 918845 | 10/1954 | Fed. Rep. of Germany . |
| 2435395 | 2/1975 | Fed. Rep. of Germany . |
| 2538650 | 5/1976 | Fed. Rep. of Germany . |

*Primary Examiner*—Francis S. Husar
*Assistant Examiner*—Gene P. Crosby
*Attorney, Agent, or Firm*—Neil F. Markva

[57] ABSTRACT

Apparatus for feeding workpieces in a multi-station cross-fed press includes two movable carrier elements on which linear guides for pairs of jaws are provided. Rotatable camshafts within carrier elements actuate the jaws via levers.

10 Claims, 7 Drawing Figures

APPARATUS FOR FEEDING WORKPIECES IN A MULTI-STATION CROSS-FED PRESS

BACKGROUND OF THE INVENTION

This invention relates to apparatus for feeding workpieces in a multi-station cross-fed press.

In such a press, metal workpieces, which are usually preheated, are subjected to plastic shaping in successive shaping operations, are picked up by a pair of gripper jaws at each shaping station to be moved to the adjacent station and there released.

There is no doubt that the feeding of workpieces constitutes one of the most critical problems in the construction of cross-fed presses. The pairs of cooperating gripper jaws must be capable of seizing large numbers of complicated parts every minute, and of moving them and releasing them at the correct moment in a precise manner.

Special problems arise with hot presses since, in certain circumstances, the heat released in the shaping zone as well as the formation of scale and the coolant spray can have a deleterious effect upon the functioning of the grippers. Efforts have therefore been made to avoid, as far as possible, a direct connection between the grippers and the die-holders of the press, i.e. to arrange the grippers at a distance from the anvil surfaces of the dies.

German Patent Specification No. 918845 discloses mounting gripper arms on two parallel shafts disposed one on each side of the shaping stations. The shafts are longitudinally displaceable and are interconnected by a bridge element so as to be drivable forward and backward in synchronism with the press. The shafts are also rotated by crank arms about their axes in opposite directions, the rotary movement being transmitted to the gripper arms which, depending upon the direction of rotation, either disengage from the workpiece or seize it.

However, since the grippers are moved about an axis during their opening and closing movements, their contact faces describe an arc which requires a relatively large amount of space and is unfavourable as regards friction during the seizing and release of the workpieces.

To avoid these difficulties, it has been proposed in German Offenlegungsschrift No. 2435395 to move the grippers parallel to the plane of the anvil by means of special guide arms during the arcuate movement. This solution, however, suffers from the disadvantage that the parallel movement of the gripper jaws is, for practical purposes, only possible at one point along their path of movement, and that the mechanism required is very complicated and likely to break down. The same is true of the construction proposed in Offenlegungsschrift No. 2538650 in which, although the grippers do move parallel to the front face of the anvil, the distance over which they open varies in dependence upon their distance from the axis of rotation.

SUMMARY OF THE INVENTION

According to the present invention there is provided apparatus for feeding workpieces in a multi-station cross-fed press, the apparatus including two parallel interconnected carrier elements and a driving mechanism to reciprocally drive the elements in synchronism with the press, pairs of gripper jaws arranged to move linearly in straight guides movable with the carrier elements, and rotatable camshafts associated with the carrier elements, a driving mechanism to oscillate the camshafts about their axes and transmission members engaging the camshafts and the gripper jaws to transmit motion from the camshafts to the jaws.

Such apparatus avoids the disadvantageous arcuate movement of the gripper and can be of uncomplicated construction while ensuring positionally exact feed of the workpiece. Furthermore, no large masses are vertically displaced in use.

Preferably, the carrier elements are hollow and the camshafts pass through them. Preferably also, at least one box-like overhung housing is secured to each of said carrier elements to project therefrom into the shaping zone of the press, a said guide for a gripper jaw being located at the free end of each housing. Further, the transmission members are preferably pivotally mounted levers engaged by springs which bias the levers towards the position in which the gripper jaws are closed.

The invention also provides a multi-station cross-fed press provided with such apparatus.

BRIEF DESCRIPTION OF DRAWINGS

The invention will be more clearly understood from the following description which is given by way of example only with reference to the accompanying drawings, in which.

DETAILED DESCRIPTION

Figure 1:
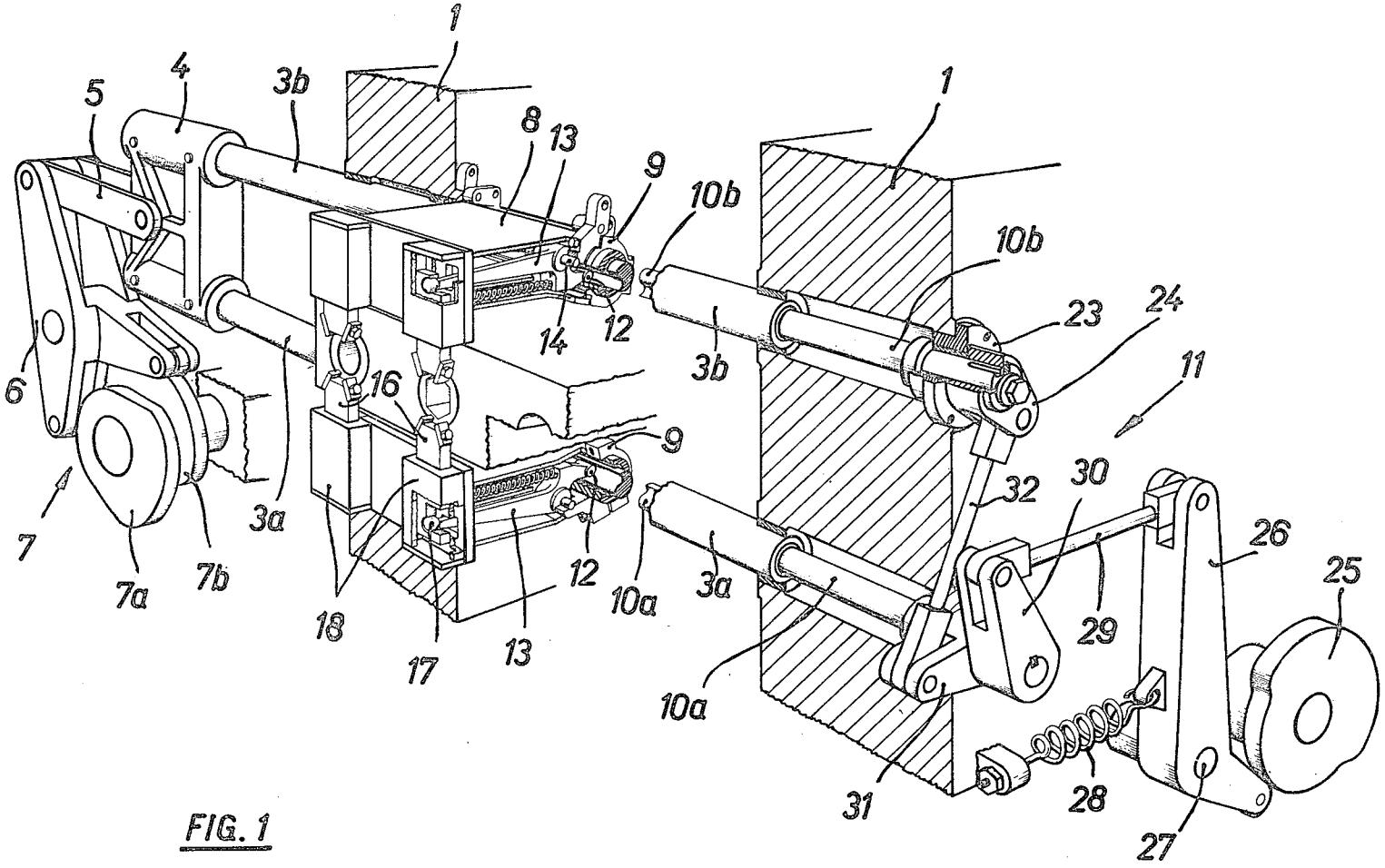
FIG. 1 is a simplified perspective view of an apparatus according to the invention used with a three-station hot press, the third shaping station having been omitted from the Figure for the sake of clarity.
Figure 2:
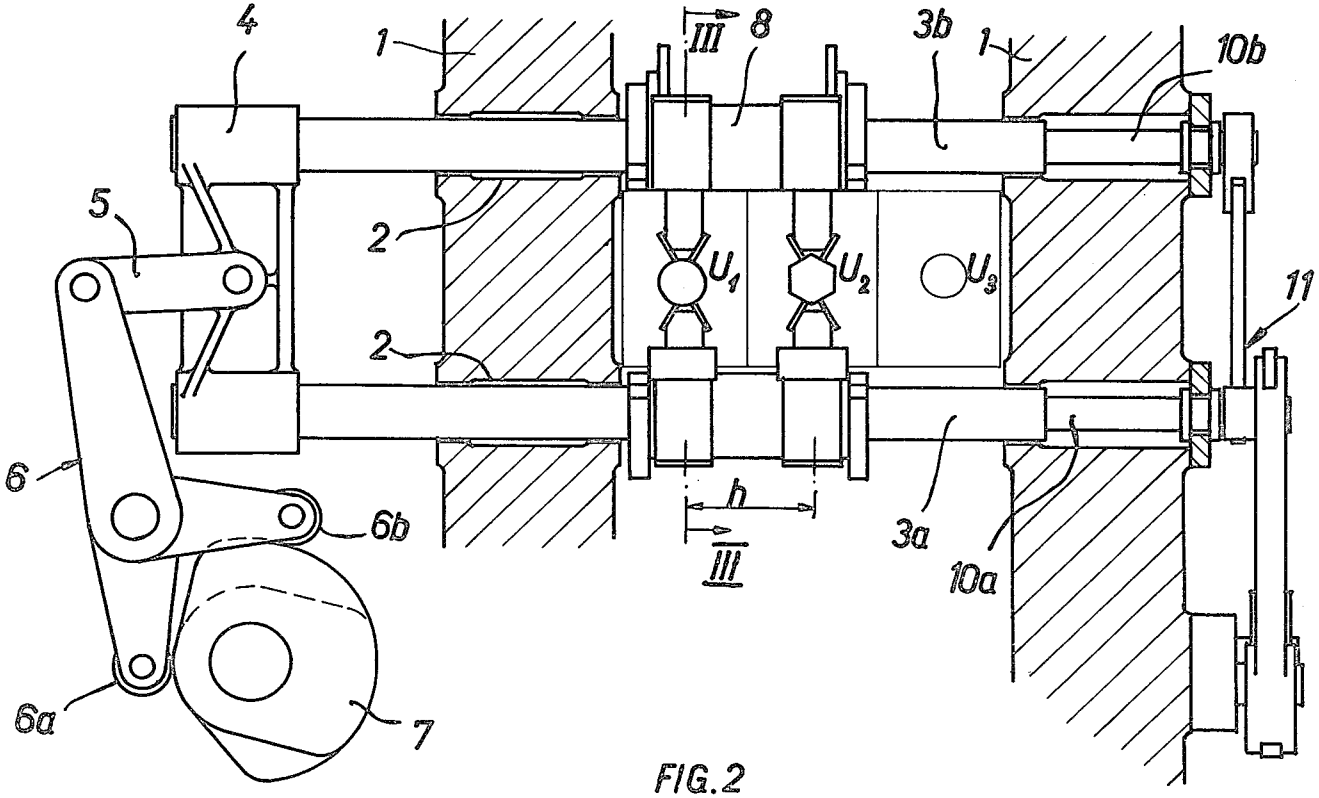
FIG. 2 shows the same apparatus in a simplified vertical longitudinal section.

FIGS. 1 and 2 show a machine body 1 which has four journal bearings 2. Two tubes 3*a* and 3*b* each comprise a carrier element and are each arranged to be axially displaceable in two of these bearings. The two carrier tubes, which are shown in their lefthand extreme positions in FIG. 2, each extend at one end into a bridge element 4 which thus interconnects the tubes to form a solid unit. A shackle plate 5 connects the bridge element 4 to a double cam-disc 7 by way of rocking lever 6. The double cam-disc comprises two discs 7*a* and 7*b* (FIG. 1), one disposed behind the other (see the FIG. 2 plan view) while rollers 6*a* and 6*b* run respectively on the peripheral faces of these discs, and are mounted on the lever 6.

Secured to the two carrier tubes are box-shaped overhung elements 8 which serve as carrier elements for gripper jaws 16. Each of the overhung elements is firmly clamped on to its carrier tube, 3*a* and 3*b* respectively, by means of a steel sleeve 9.

Camshafts 10*a* and 10*b* are respectively rotatably mounted within carrier tubes 3*a* and 3*b*. Camshafts 10*a* and 10*b* are oscillated through a predetermined angle of rotation in synchronism with the press by a drive mechanism 11, described hereinafter, and as shown in FIG. 1. Each camshaft 10*a* and 10*b* has a special cross-section in its operative zone, on which is located a feeler roller 12 of an angled transmission lever 13 (see also FIG. 3) which extends through a slot in the carrier element. The angled transmission levers 13 are rotatable in the elements 8 about fixed shafts 14 and have front end portions which carry balls 17, extending into recesses 15 formed in gripper jaws 16. The latter are mounted in straight gripper carriers 18 to slide rectilinearly therein, i.e. in the vertical direction in this case.

Figure 3:
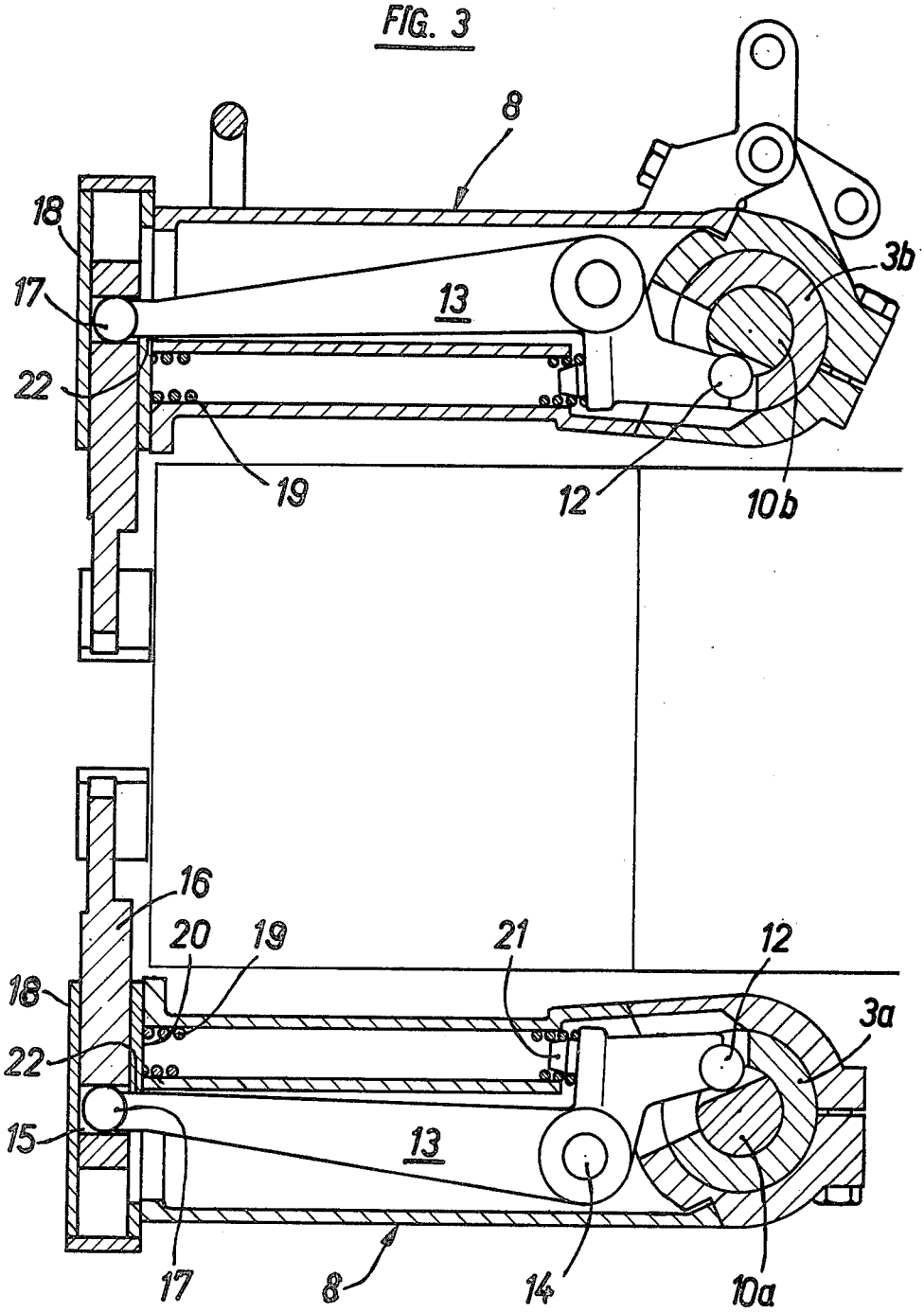
FIG. 3 is a section along the line III—III of FIG. 2.

As best seen from FIG. 3, gripper carriers 18 are secured to the front ends of overhung elements 8 by means of flanges.

Helical springs 19, which are arranged between backing members 20 and centering pins 21 of the transmission levers 13, apply load to the transmission levers 13 so that the springs associated with the two cooperating gripper jaws of each part bias the lower jaw 16 upwardly and the upper jaw downwardly and thus urge the gripper towards the closed position. However, the angle of rotation of transmission levers 13 is limited by stops 22 in such a way that the position of the jaws just permits a workpiece to be inserted.

In this closed position of gripper jaws 16 there is also clearance between the rollers 12 and the adjacent control faces of the camshafts 10*a* and 10*b*, which clearance is always present even when feed of a workpiece is not taking place. The springs 19 urge levers 13 against stops 22. When a workpiece is received, gripper jaws 16 are forced slightly apart, levers 13 move away from stops 22, and at the same time the clearance between rollers 12 and camshafts 10*a* and 10*b* is increased. Thus, during operation, the final phase of the closing movement of the jaws, which is the most important one as regards seizing of the workpiece, occurs in a mechanically positive manner under the action of springs 19, so that variations in the size of the workpieces or their insertion at the wrong angle are accommodated.

Furthermore, the spring forces selected to act on the lower gripper jaws 16 may be considerably greater than, for instance one and a half times those acting on the upper jaws; thus, the lower springs precisely position the workpieces when being seized or inserted. As soon as a workpiece has been inserted between the waiting gripper jaws, the upper jaw moves upwards slightly because of the smaller spring force applied to it, and the workpiece is positioned in a reliable manner. Thus, when the workpiece is received, the lower gripper jaw lies against the stop (22, FIG. 3), whereas the upper gripper jaw gives way.

Figure 4:
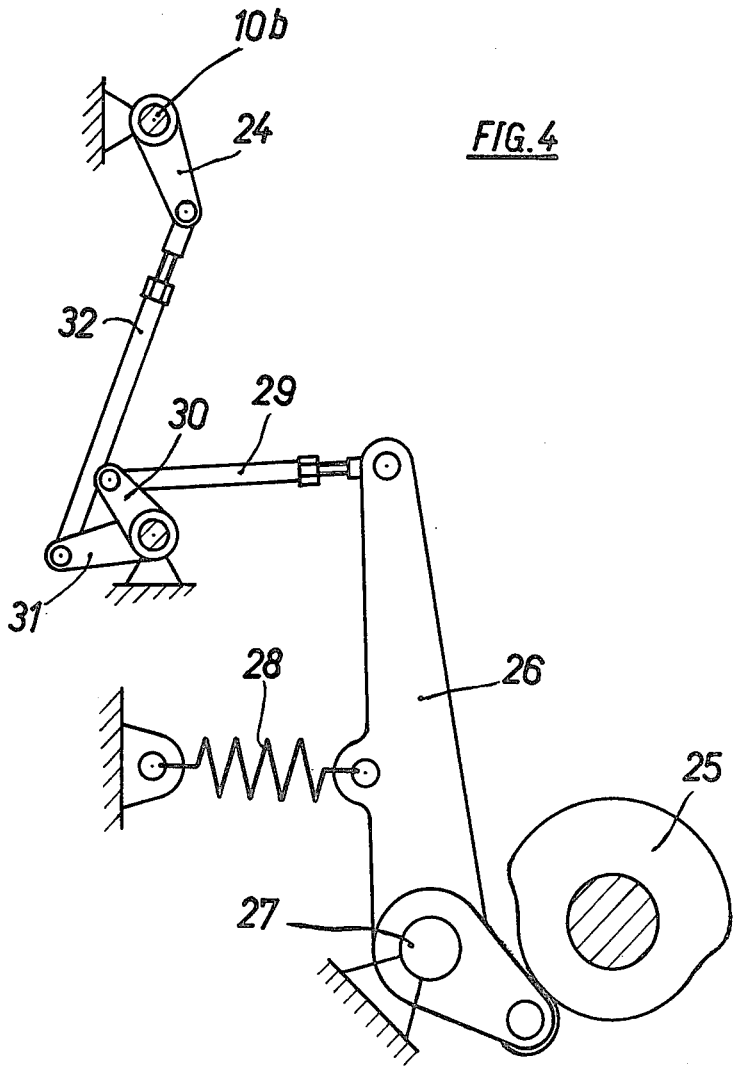
FIG. 4 illustrates diagrammatically the drive for the two camshafts of the apparatus of the preceding Figures.

In the arrangement illustrated in FIG. 1, the camshafts 10*a* and 10*b* are mounted within the carrier tube 3*a* and 3*b* respectively in which they are displaceable in the axial direction. The carrier tubes 3*a* and 3*b* can thus slide forward and backward on camshafts 10*a* and 10*b* under the action of the double cam disc 7. Each stroke h (FIG. 2) corresponds to half the distance between two adjacent shaping stations U1 and U2. The ends of the two camshafts 10*a* and 10*b* are mounted to rotate in the machine body 1 with the aid of bearing inserts 23, and they are keyed to drive levers of a drive mechanism 11. As shown in FIG. 1 and the diagrammatic illustration in FIG. 4, this includes a transmission rod system which comprises a cranked roller rocking lever 26 which rocks about a shaft 27 and is held in contact with the cam-disc 25 by a spring 28; a coupling arm 29 and a drive lever 30 which is keyed to the camshaft 10*a*. A second lever 31 is also keyed to the camshaft 10*a*, and this lever is displaced from the drive shaft 30 through a certain angle and drives the upper camshaft 10*b* by way of a coupling arm 32 and a second drive lever 24.

The rotary movement of the cam-disc 25 is thus transmitted by way of the above-described system to the two camshafts 10*a* and 10*b* and from these to the gripper jaws by way of the transmission levers 13.

Figure 6:
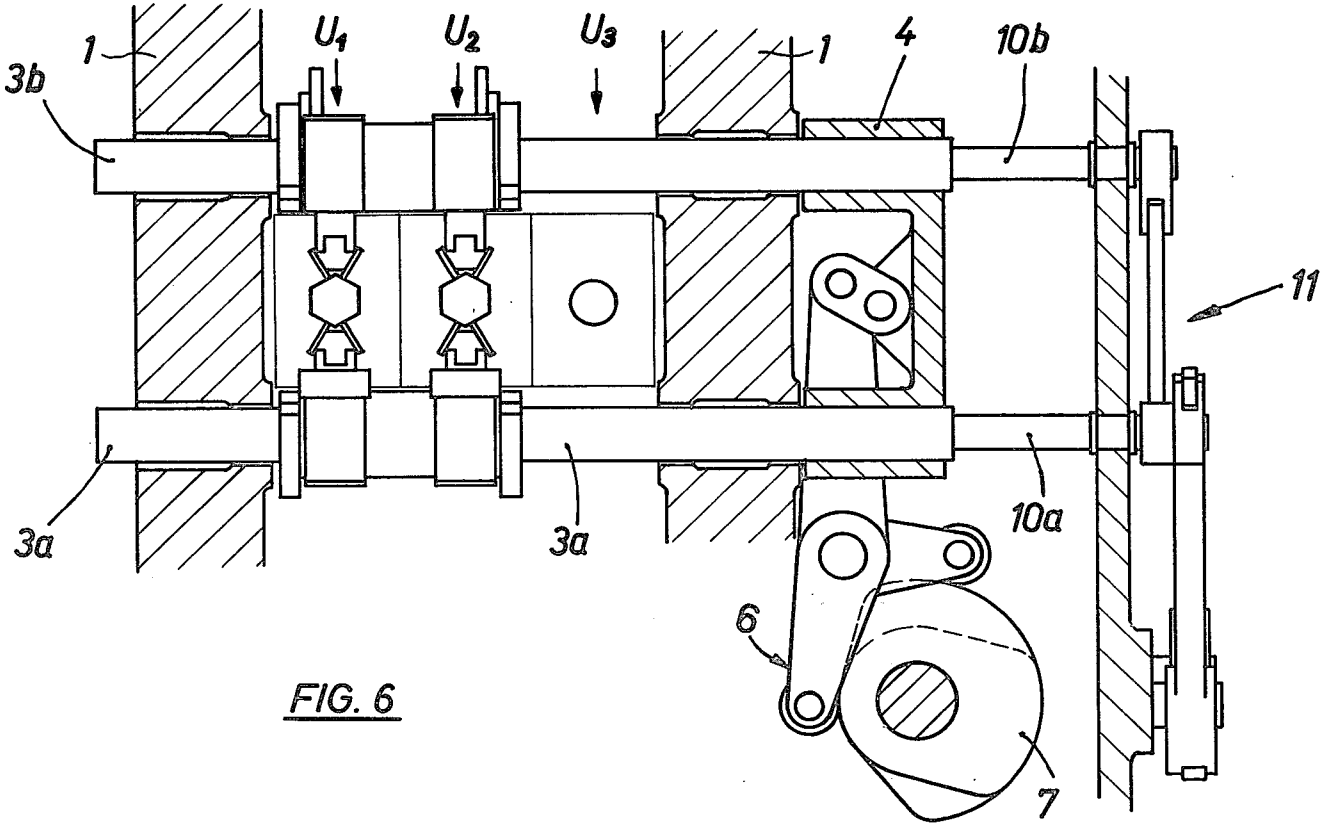
FIG. 6 illustrates a modified construction in the same way as in the section in FIG. 2.

The construction described represents just one of many possible arrangements in accordance with the invention, and can be modified in many ways by persons skilled in the art. Thus, for example, it is possible to position the drive arrangements for the camshafts and carrier tubes on the same side of the body of the press as is illustrated in FIG. 6. In this Figure the same reference numerals as those previously used are retained for designating fundamentally similar parts; and the only difference between the FIG. 6 arrangement and that of FIG. 2 is that the bridge element interconnecting the two carrier tubes 3*a* and 3*b* is arranged alongside the drive mechanism 11 for the camshafts. Further forms of the drive arrangement are of course possible.

Figure 5:
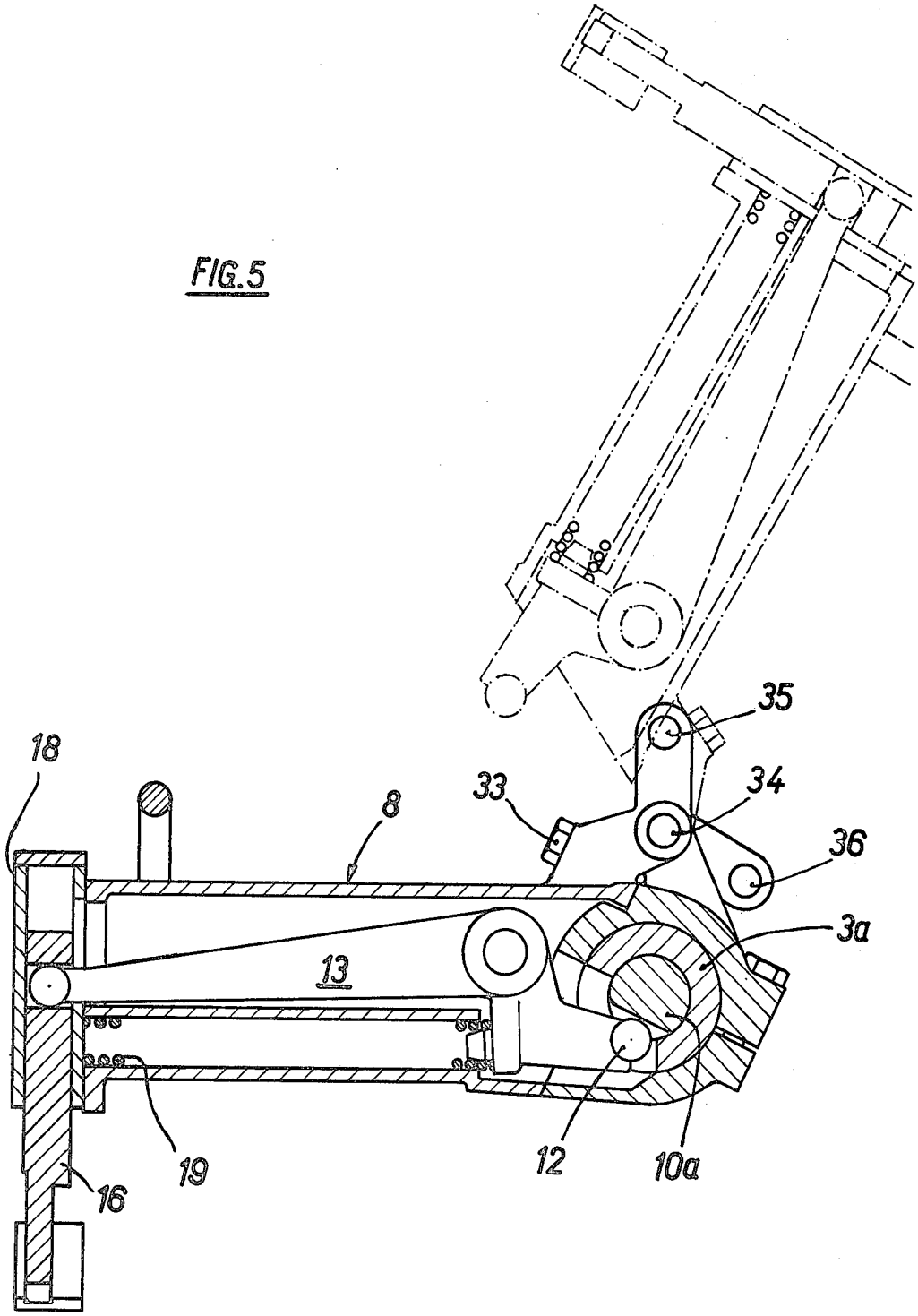
FIG. 5 is a sectional view similar to that of FIG. 3 but showing, in chain-dot lines, the upper overhung housing in a raised position.

Referring now to FIG. 5, it can be seen that the upper overhung element 8 including the gripper unit can be swung up about a swivel shaft 34 into the position shown in chain-dot lines after a fixing screw-bolt 33 has been uptightened. When a certain angular position is reached, holes 35 and 36 drilled in two coupling plates, are in register and can then be retained in this position by means of a screw-bolt. This special feature enables the entire upper overhung element 8 to be secured in the upper position to enable a set of dies to be removed; and the machine can then be run at high speed for test purposes without the upper overhung element being lowered. The dies, which are then easily reached, can be lifted out.

Figure 7:
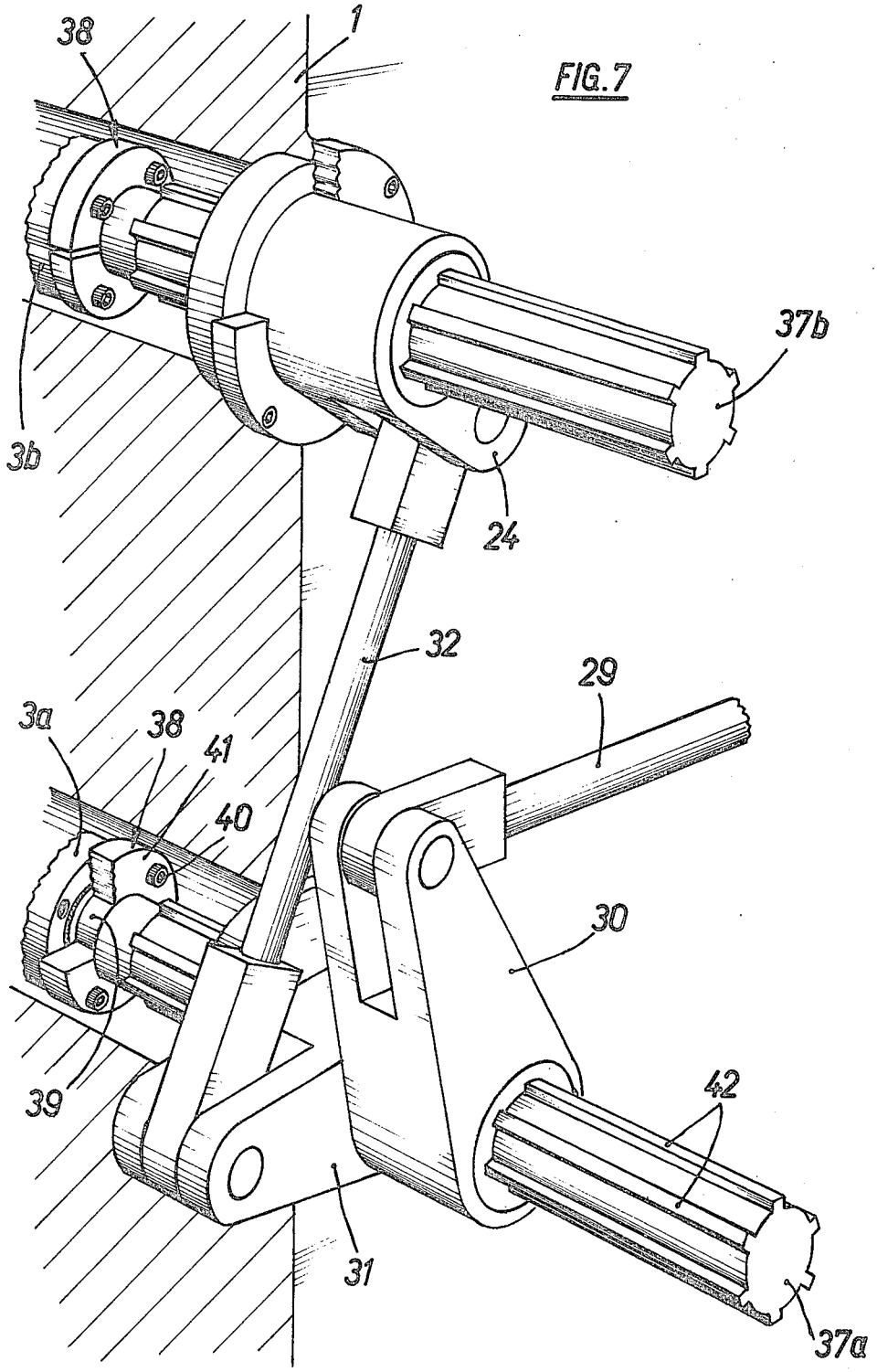
FIG. 7 is a perspective illustration of a further possible way of arranging the camshafts and carrier elements relative to each other.

In the arrangement illustrated in FIGS. 1 and 2, the carrier tubes 3*a* and 3*b* and elements 8 can be displaced axially in relation to the camshafts 10*a* and 10*b*. A modified arrangement is illustrated in FIG. 7. In this case the camshafts, here designated by the numerals 37*a* and 37*b*, are connected to the carrier tubes 3*a* and 3*b* respectively by means of thrust bearings 38, so that although the camshafts are now moved along by the carrier tubes during the axial oscillating movement of the latter, they are able to rotate freely. For this purpose the camshaft 37*a* (the form of which is identical to that of the camshaft 37*b*), is provided with an annular machined channel 39 in which is fitted a clamping ring 41 secured to the carrier tube by means of screw-bolts 40. Thus the clamping ring 41 secures the camshaft 37*a* against axial movement with respect to the carrier tube. During the swinging movement of the camshaft 37*a*, the surface of the channel 39 slides relative to the wall of the bore of the clamping ring so that the carrier tube does not participate in the rotary movement of the camshaft.

Since, when the press is operating, the carrier tube 3*a* moves forward and backward and is connected to the camshaft by the thrust bearing 38, means must be provided to enable the camshaft to move relatively to its fixed drive mechanism. For this reason, the driven end portion of the camshaft has a splined contour 42 which, in a corresponding manner, is also fitted into the bores of the drive levers 30 and 31. Thus the camshafts are able to slide freely in the axial direction in the swinging drive levers of the drive mechanism and can therefore take up the swinging movement from the drive mechanism.

Although the arrangement illustrated in FIG. 7 necessitates the more costly splining of the end portions of the end portions of the camshafts, the camshafts need be otherwise splined only along a portion corresponding to the width of the rollers 12 (FIG. 3). In the arrangement shown in FIGS. 1 and 2 however, the splining extends along the camshafts at least over a length corresponding to the transverse feed stroke h plus the width of the roller 12.

An important advantage of the apparatus described resides in the fact that the overhung elements 8, serving as gripper carriers, are moved only in the direction in which transverse feed takes place and in that, contrary to previous practice, a vertical movement for opening and closing the grippers does not need to be superposed upon said transverse movement. Thus, during operation of the machine, oscillations are avoided or kept within tolerable limits.

The apparatus that has been described is of simple and readily supervised construction and is also notable for its relatively small mass, since the overhung housings may be made of light metal. Parts subjected to heavy wear can be easily replaced since they are readily accessible.

In view of the arrangement of the camshafts within the carrier tubes, no levers, cam shoes, or other transmission elements necessarily involving clearances need be included in the construction for the purpose of transmitting movement to the transmission levers 13.

Since, furthermore, there is clearance between the camshafts and the guide rollers 12 on the transmission shafts 13 during feeding of workpieces, wear on those components is also reduced to a minimum.

The large amount of space available within the overhung housing for accommodating the springs 19 enables a soft spring characteristic to be achieved, so that a large gripper force, acting on the pressings, can be attained.

Since the gripper jaws are guided rectilinearly, their movement is a straightforward vertical displacement so that when the grippers are opened the pressings are not affected by transverse components of the gripper movement as is the case in known systems.

In operation, workpieces are passed to successive stations by being gripped, moved laterally on movement of the carrier elements, are then released at their next stations while the jaws open and the carrier elements return, this occurring while the press is operating to shape the workpieces.

I claim:

1. Apparatus for feeding workpieces being acted on in a multi-station cross-fed press, said apparatus comprising in combination:

(a) two parallel interconnected hollow carrier elements, (b) a first driving mechanism connected to the carrier elements and adapted to reciprocally drive the elements in synchronism with the press, (c) pairs of gripper jaws, (d) straight guides which are movable with the carrier elements and in which said gripper jaws are arranged to move linearly, (e) rotatable camshafts which pass through the carrier elements, (f) a second driving mechanism connected to the camshafts and adapted to oscillate the camshafts about their axes, and (g) transmission members engaging the camshafts and the gripper jaws and adapted to transmit motion from the camshafts to the jaws.

2. Apparatus as claimed in claim 1, wherein the carrier elements are tubes of circular cross-section adapted to be mounted on the body of the press, one said tube being mountable at each side of the pressing zone.

3. Apparatus as claimed in claim 1, wherein each camshaft is rigidly connected to the second drive mechanism both axially and rotationally and the camshafts are longitudinally displaceable in the carrier elements.

4. Apparatus as claimed in claim 1, wherein thrust bearings connect the camshafts to the carrier elements such that the camshafts are axially movable with the carrier elements but rotatable relative thereto, the camshafts having driven end portions connected to the second drive mechanism by splines.

5. Apparatus as claimed in claim 1, wherein at least one box-like overhung housing is secured to each of said carrier elements to project therefrom into the shaping zone of the press, each said housing having a free end at which a said guide for a gripper jaw is located.

6. Apparatus as claimed in claim 5, wherein said transmission members comprise pivotally mounted levers, and springs biassingly urge the levers toward the position in which the gripper jaws are closed, and a stop is provided within each housing, which stop limits movement of the associated lever in the direction of closing of the gripper jaws, and thereby defines a closed position of the jaws.

7. Apparatus as claimed in claim 6, wherein a roller is located at that end of each lever adjacent the associated camshaft, there being a clearance between said roller and said camshaft when the gripper jaws are in the closed position as defined by the stops.

8. Apparatus as claimed in claim 1, wherein said transmission members comprise pivotally mounted levers, and springs biassingly urge the levers toward the position in which the gripper jaws are closed.

9. Apparatus as claimed in claim 8, wherein said springs supply forces with differing magnitudes which act on the gripper jaws of a pair.

10. Apparatus as claimed in claim 9, wherein a multi-station cross-fed press is operating in the horizontal direction, said apparatus having lower and upper gripper jaws and the forces of the springs acting on the lower gripper jaws are at least one and a half times those forces of the springs acting on the upper gripper jaws.

* * * * *